US007455382B2

(12) United States Patent
Kuribayashi et al.

(10) Patent No.: US 7,455,382 B2
(45) Date of Patent: Nov. 25, 2008

(54) RECORDING APPARATUS FOR DETECTING POSITION OF INK TANK AND POSITION DETECTING METHOD OF THE INK TANK

(75) Inventors: Akira Kuribayashi, Kawasaki (JP); Yasuhiko Ikeda, Sagamihara (JP); Mitsuyuki Fujibayashi, Kawasaki (JP); Takayuki Ochiai, Inagi (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 11/424,944

(22) Filed: Jun. 19, 2006

(65) Prior Publication Data

US 2006/0284917 A1 Dec. 21, 2006

(30) Foreign Application Priority Data

Jun. 21, 2005 (JP) ..... 2005-180557

(51) Int. Cl.
*B41J 29/393* (2006.01)
*B41J 2/175* (2006.01)

(52) U.S. Cl. ..... 347/19; 347/86

(58) Field of Classification Search ..... 347/5, 347/9, 19, 86, 87

See application file for complete search history.

(56) References Cited

U.S. PATENT DOCUMENTS

| | | | | |
|---|---|---|---|---|
| 4,872,027 | A * | 10/1989 | Buskirk et al. | 347/19 |
| 4,930,915 | A * | 6/1990 | Kikuchi et al. | 400/175 |
| 5,049,904 | A * | 9/1991 | Nakamura et al. | 347/19 |
| 6,299,274 | B1 * | 10/2001 | Bolash et al. | 347/19 |
| 2005/0219303 | A1 * | 10/2005 | Matsumoto et al. | 347/19 |

* cited by examiner

*Primary Examiner*—Anh T. N. Vo
(74) *Attorney, Agent, or Firm*—Canon U.S.A., Inc., IP Division

(57) ABSTRACT

A recording apparatus and method for detecting the mounting position of an ink tank within the recording apparatus, whereby it is determined whether the ink tank is mounted in the correct position. In addition, it is also determined whether there an abnormality exists with a light receiving portion of the recording apparatus, where the light receiving portion is used in determining whether an ink tank is mounted in the correct position.

8 Claims, 17 Drawing Sheets

RECORDING APPARATUS FOR DETECTING POSITION OF INK TANK AND POSITION DETECTING METHOD OF THE INK TANK

CROSS-REFERENCE TO RELATED APPLICATIONS

This application is related to the following applications, all of which are filed on the same day and assigned to the same assignee as the present application:

"Recording Apparatus and Method for Detecting the Position of an Ink Container"—Ser. No. 11/424,954

"Recording Apparatus Capable of Checking Positions of Ink Containers, and Method for Checking the Positions"—Ser. No. 11/424,950

"Ink Tank Position Detection Method"—Ser. No. 11/424,940

BACKGROUND OF THE INVENTION

1. Field of the Invention

The present invention relates to detection of ink tank mounting positions within a recording apparatus and the status of the recording apparatus' mechanism used to determine the mounting positions.

2. Related Background Art

In recent years, in association with the spread of digital cameras, the number of applications in which a digital camera and a printer are directly connected, without the aid of a personal computer (PC), to print digital images has been increasing. In addition to printing directly from a digital camera, other methods of printing without the use of a PC that have been gaining in popularity include removing the storage medium (e.g., compact flash card, secure digital card, etc.) from a digital camera and connecting the storage medium directly to the printer.

In the case of printing using a PC, it is known to confirm the ink residual amount in an ink tank of a printer using the PC's display. The need to confirm ink residual amount in the case of printing without using a PC has been increasing. For example, if a user can preliminarily recognize the fact that ink residual amount in the ink tank is small, the user, for example, can exchange the ink tank for a new ink tank prior to starting printing, thus avoiding any problems (e.g., incomplete printing) that may occur during printing due to the lack of ink.

Hitherto, notifying a user of the condition of an ink tank using a display device such as an LED or the like has been known. In Japanese Patent Application Laid-Open No. H04-275156, two LEDs are provided for an ink tank integrally mounted with a recording head, where each of the LEDs is turned on in accordance with an ink residual amount of two stages.

To satisfy the requirement for higher picture quality, in addition to the conventional four color inks (black, yellow, magenta, cyan), various types of ink, such as light magenta and light cyan, whose concentration is low have been used. Further, the use of so-called particular color inks, such as red ink and blue ink, has been proposed. When these inks are used, seven or eight ink tanks corresponding to the colors are individually mounted in an inkjet printer. In this case, a mechanism is necessary to prevent the ink tank from being mounted at wrong positions. Japanese Patent Application Laid-Open No. 2001-253087 discloses that the engaged portions between a carriage and ink tanks have different shapes. This prevents the ink tanks from being improperly mounted.

In order to specify the mounting positions of the ink tanks, the engaged portions between the carriage and the ink tanks have different shapes, as described above. In this case, however, it is necessary to produce ink tanks that have different shapes corresponding to the colors and types of ink. This is disadvantageous in terms of production efficiency and cost.

As another method, it is conceivable to separately provide different circuit signal lines of circuits, which are formed by connecting electrical contacts of ink tanks and electrical contacts provided at the mounting positions of the ink tanks in a carriage of a main unit, corresponding to the mounting positions. For example, it is conceivable to respectively provide different signal lines corresponding to the mounting positions in order to read ink color information from the ink tanks, and to control lighting of LEDs. When the color information read from any of the ink tanks does not correspond to the mounting position, it is determined that the ink tank is mounted improperly.

Such a construction that the signal line is individually provided every ink tank or mounting position results in an increase in the number of signal lines. Particularly, as mentioned above, in the recent ink jet printers or the like, there is a tendency that the picture quality is improved by increasing the number of kinds of ink to be used. In such a printer, particularly, the increase in the number of signal lines becomes a factor of the increase in costs or the like. A construction such as bus connection of what is called a common signal line is effective in order to reduce the number of wirings. However, according to the construction such as bus connection merely using the common signal line, it will be obviously understood that the ink tank or its mounting position cannot be specified.

Accordingly, a position checking method is conceivable in which lighting of LEDs at mounting positions of a plurality of ink tanks is controlled by a common signal line, and in which the mounting positions of the ink tanks can be determined. However, the amount of emitted light varies among the LEDs, and therefore, the amount of light received by a light receiver provided in the printer also varies. For this reason, it is sometimes difficult to check the presence or absence of emitted light with reference to a threshold value depending on the amount of received light, and to thereby check the positions of the ink tanks. Although this problem can be solved by reducing the variation in the amount of emitted light, the cost is increased, for example, because there is a need to screen LEDs.

However, if the mounting position of the ink tank cannot be correctly specified due to the occurrence of a failure of the photosensitive device, deterioration of photosensitivity by ink mist, or the like, it is impossible to determine that such a problem has been caused by the erroneous mounting of the ink tank or by the failure of the main body. Thus, such a problem that the ink tank is unnecessarily exchanged occurs.

SUMMARY OF THE INVENTION

The present invention is directed to a position checking method that can specify mounting positions of liquid containers, such as ink tanks.

According to an exemplary embodiment of the present invention, a recording apparatus includes a carriage, a plurality of liquid containers mounted in the carriage and having respective light emitting portions and a light receiving portion which can receive light from the light emitting portions. The recording apparatus further includes a light emission control unit adapted to control a light emitting portion of a predetermined one of the ink tanks to emit light, a first determining unit adapted to determine whether a mounting position of the predetermined ink tank is correct based on a result obtained when the light receiving portion has received the light emitted from the light emitting portion at a plurality of positions, a driving unit adapted to drive the carriage, a second determination unit adapted to, if it is determined by the first determination unit that the mounting position of the predetermined ink tank is incorrect, determine a maximum value from results obtained when the driving unit has driven the carriage to a position where the mounting position of the ink tank whose mounting position is incorrect faces the light receiving portion and, thereafter, the light emission control unit further controls the light emitting portion of the ink tank whose mounting position is incorrect to sequentially emit light at a plurality of positions, and a third determination unit adapted to determine that an abnormality has occurred in the light receiving portion if the maximum value determined by the second determining unit does not satisfy a predetermined value.

DETAILED DESCRIPTION OF THE PREFERRED EMBODIMENTS

1. Ink Tank

Figure 10A:
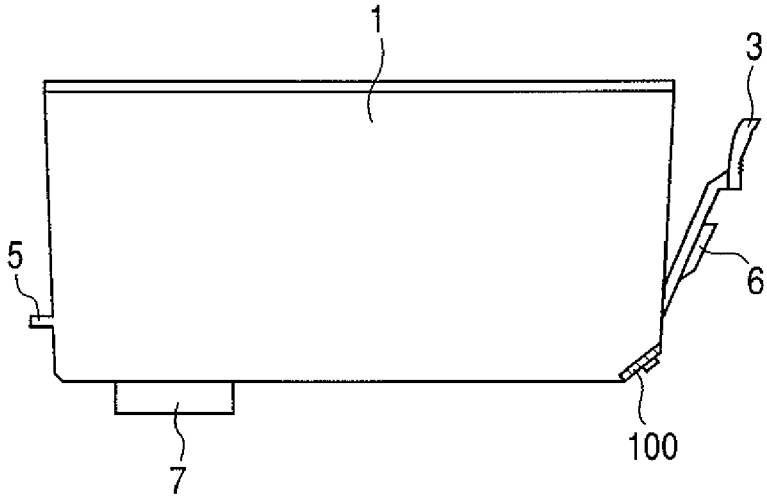
FIGS. 10A, 10B and 10C are views of the ink tank according to the exemplary embodiment of the invention.
Figure 10B:
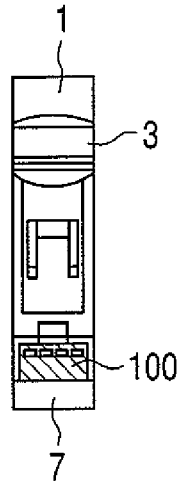
Figure 10C:
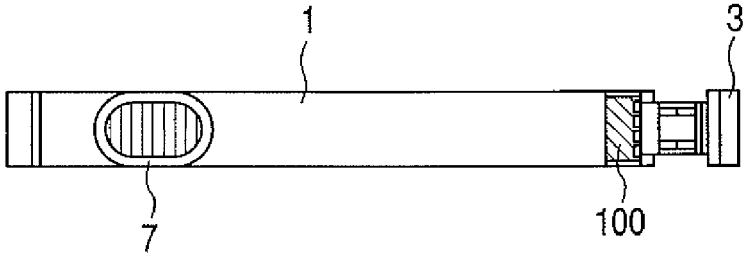

FIGS. 10A to 10C are side, front view, and bottom views respectively of ink tanks used in an ink jet recording apparatus according to the present invention. The front side of the ink tank denotes the side where when the ink tank faces the user, where the user is enabled to operate the ink tank (e.g., inserting and removing) and information can be provided to the user (e.g., light emission of an LED, which will be explained below).

Figure 1A:
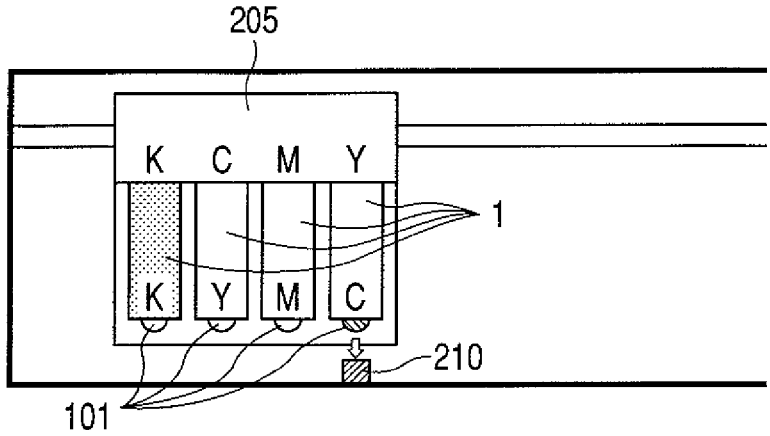
FIGS. 1A, 1B, 1C and 1D are diagrams for explaining an error position minute investigation process according to an exemplary embodiment of the invention.

In FIG. 1A, an ink tank 1 includes a supporting member 3 connected to a lower portion of the front side. The supporting member 3 is made of a resin and is integrated with an outer casing (now shown) of the ink tank 1. When the ink tank 1 is mounted to a tank holder (not shown), which will be explained below, the shape of the supporting member 3 can be manipulated. A first engaging portion 5 and a second engaging portion 6 (in the present exemplary embodiment, they are integrated with the supporting member 3) each of which can engage a retaining portion of the tank holder are provided on the rear side and the front side of the ink tank 1 respectively. Engagement of the first engaging portion 5 and the second engaging portion 6 ensure that the ink tank 1 is mounted to the tank holder.

An ink supply port 7 which is coupled with an ink introducing port (not shown) of a recording head, which will be explained below, and supplies ink when the ink tank 1 is mounted to the tank holder, is provided for the bottom surface of the ink tank 1. In the crossing portion of the bottom surface and the front surface, the board 100 serving as a main portion of the embodiment is provided for the bottom side of the supporting portion of the supporting member 3.

Figure 11A:
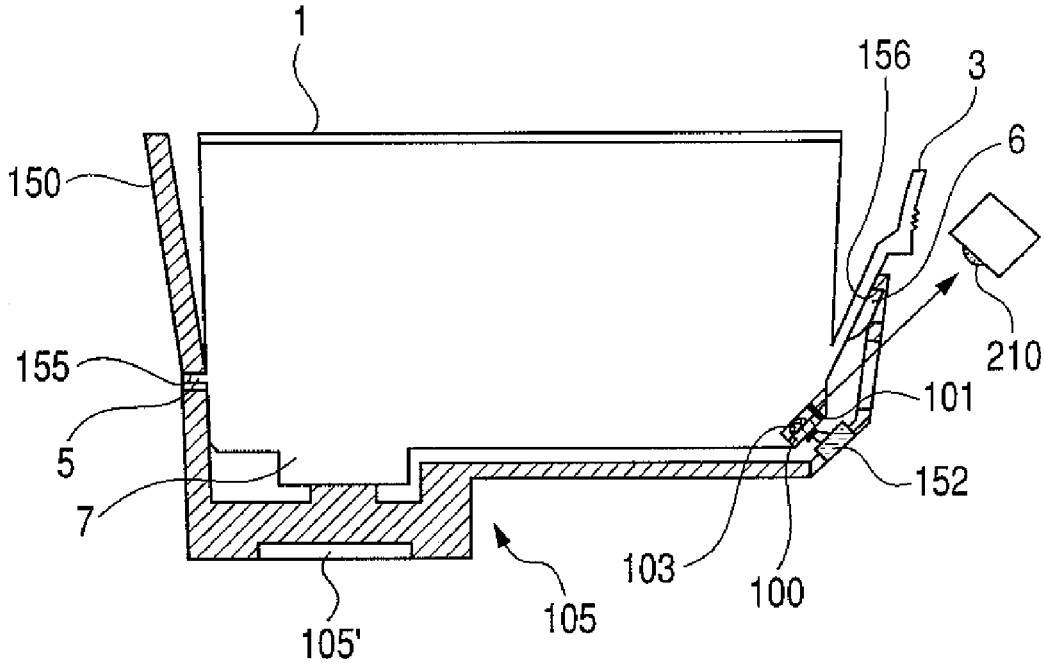
FIGS. 11A and 11B are schematic side views for explaining an outline of a function of a board which is arranged to the ink tank according to the exemplary embodiment of the invention.
Figure 11B:
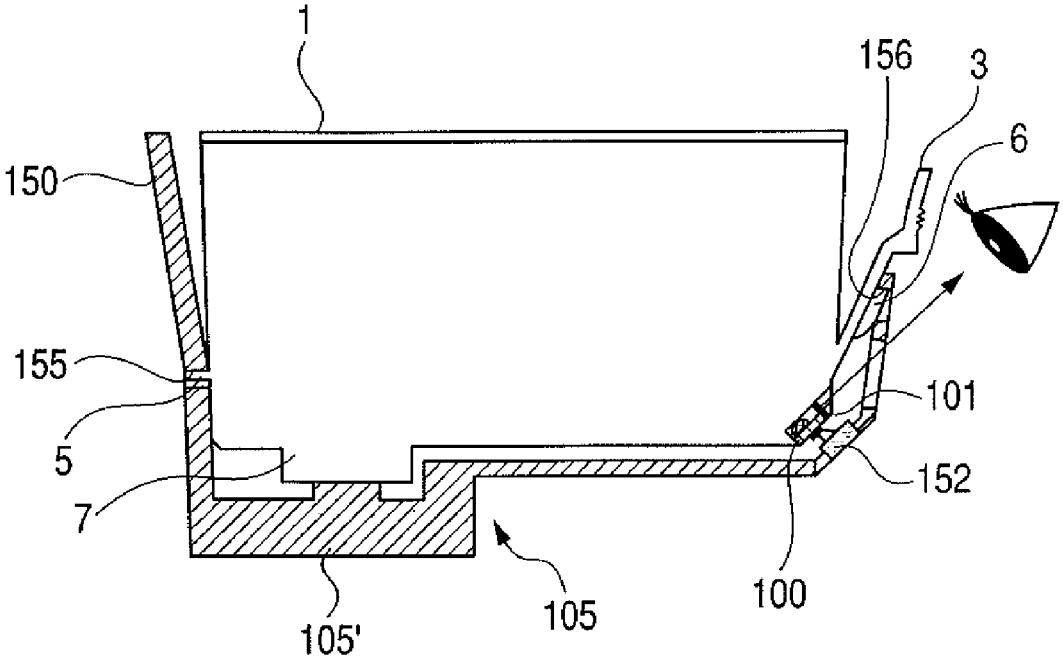

FIGS. 11A and 11B are schematic side views for explaining an outline of a function of a board which is arranged to the ink tank 1, where the ink tank 1 is detachably mounted in the recording head unit 105.

The ink tank 1 is mounted and fixed onto a holder 150, 155, 156. In this instance, a contact (hereinafter, referred to as a connector) 152 provided for the holder 150 contacts an electrode pad 102 as a contact provided for the surface locating so as to face the outside of a board 100 provided for the ink tank, thereby enabling electrical connection to be made.

A first light emitting portion 101, such as an LED or the like, for emitting visible light and a control device 103 to control the first light emitting portion are provided on the surface of the board 100. The control device 103 controls light emission of the first light emitting portion 101 on the basis of an electric signal which is supplied from the connector 152 through the pad 102.

As mentioned above, in the crossing portion where both sides of the bottom surface and the front surface of the ink tank 1 cross, the board 100 serving as a main portion of the embodiment is arranged below the supporting portion of the supporting member 3. Arranging of the board 100 in this manner results in the formation of an oblique surface connecting both sides on the ink tank 1. Therefore, when the first light emitting portion 101 emits the light, a part of the light is projected from the front side of the ink tank 1 toward the outside along the oblique surface.

By using the board 100 arranged in this manner, predetermined information regarding the ink tank 1 can be directly presented not only to the recording apparatus but also to a host apparatus such as a computer or the like to which the recording apparatus is connected, and to a user while using the first light emitting portion 101. That is, as shown in FIG. 11A, in an edge portion of a scanning range of the carriage on which the holder 150 has been mounted, a light receiving portion is arranged at a position where the light emitted in the upper right direction in the diagram is received.

By controlling the light emission of the first light emitting portion 101 when the carriage is located at such a position, the recording apparatus side can recognize the predetermined information regarding the ink tank 1 from the contents of the light received by the light receiving portion 210. For example, by locating the carriage to the center of the scanning range and controlling the light emission of the first light emitting portion 101, as shown in FIG. 11B, the user can recognize the predetermined information regarding the ink tank 1 by observing the light emitting state.

2. Recording Apparatus

Figure 12:
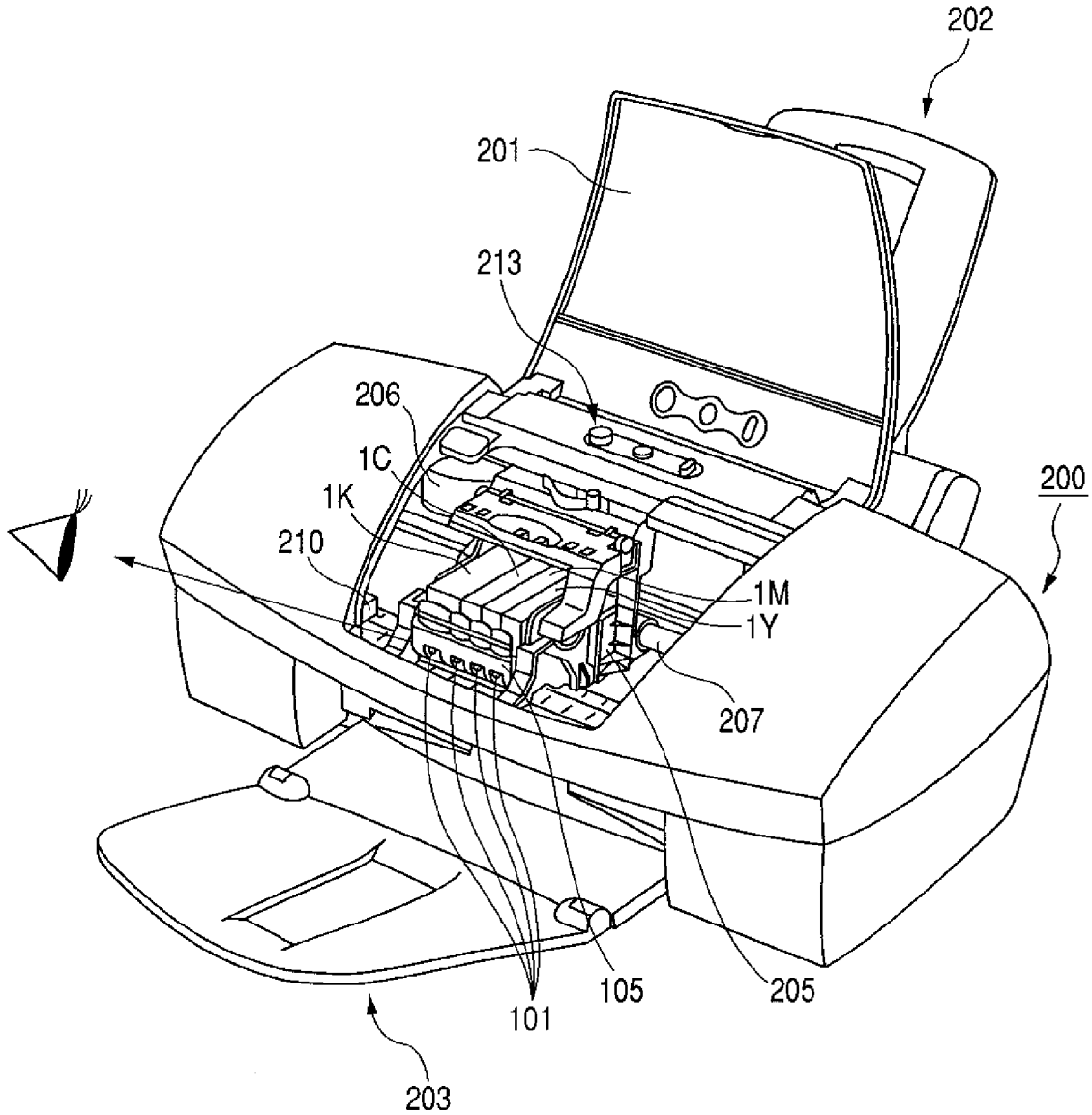
FIG. 12 is a perspective view of an ink jet printer in which ink tanks according to the exemplary embodiment have been mounted and which executes recording and shows the state where a main body cover 201 of the printer has been opened.

FIG. 12 is a perspective view of an ink jet printer 200 in which the ink tanks described above have been mounted and which executes recording. FIG. 12 also shows the state where a main body cover 201 of the ink jet printer 200 has been opened.

As shown in FIG. 12, a main part of the inkjet printer 200 is formed by a mechanism that performs recording by scanning a carriage 205 on which recording heads and ink tanks are mounted. The main part includes a main unit covered with the main cover 201 and other case portions, ejection trays 203 respectively provided on the front and rear sides of the main unit, and an automatic sheet feeder (ASF) 202. The printer 200 also includes an operating unit 213 having a display that indicates the condition of the printer 200 in both states in which the main cover 201 is closed and opened, a power switch, and a reset switch.

In a state in which the main cover 201 is opened, a user can see a range in which the carriage 205 having a recording head unit 105 and ink tanks 1K, 1C, 1M, and 1Y mounted thereon moves, and the surroundings of the range (hereinafter, the ink tanks 1K, 1C, 1M, and 1Y are sometimes denoted by the same reference numeral "1"). In actuality, when the main cover 201 is opened, a sequence in which the carriage 205 automatically moves to almost the center position in the figure (hereinafter also referred to as a "tank replacement position") is performed. The user can replace each ink tank at the tank replacement position.

The recording head unit 105 includes chip-shaped recording heads (105' in FIGS. 11A and 11B) corresponding to color inks of K, C, M, and Y. The recording heads are scanned over a recording medium, such as a sheet of paper, by the movement of the carriage 205, and discharge ink onto the recording medium for recording during the scanning operation. That is, the carriage 205 is slidably engaged with a guide shaft 207 that extends in the moving direction thereof, and can be moved by a carriage motor and a mechanism for transmitting the driving force from the carriage motor. The recording heads respectively discharge the K, C, M, and Y color inks according to discharging data sent from a control circuit in the main unit via a flexible cable 206. A sheet feeding mechanism including a sheet feeding roller and an ejection roller is also provided to convey a recording medium (not shown) supplied from the automatic sheet feeder 202 onto the ejection tray 203. The recording head unit 105 with which ink tank holders are provided integrally is detachably mounted on the carriage 205. The ink tanks 1 are detachably mounted in the recording head unit 105.

During recording, each of the recording heads is scanned while discharging ink onto the recording medium to record in a region having a width corresponding to discharge openings of the recording head. Also, the recording medium is conveyed by a predetermined amount corresponding to the above-described width by the sheet feeding mechanism between scanning operations, so that recording on the recording medium is performed sequentially. A discharging recovery unit, such as a cap, is provided at an end of the range, in which the recording heads are moved by the movement of the carriage 205, to cover surfaces of the recording heads on which the discharge openings are provided. The recording heads are moved to the recovery unit at predetermined time intervals so as to be subjected to recovery operation such as preliminary discharging.

The recording head unit 105 having the tank holders for the ink tanks 1 has connectors corresponding to the ink tanks 1, as described above. Each of the connectors is in contact with a pad provided on the corresponding ink tank 1. This allows control of lighting and flashing of each LED 101.

More specifically, at the tank exchange position mentioned above, when the ink residual amount decreases with respect to each ink tank 1, the LED 101 of the relevant ink tank 1 is turned on or flickers. In the moving range of the carriage, a first light receiving portion 210 having a photosensitive device is provided near an edge portion on the side opposite to the position where the foregoing recovery unit has been arranged. When passing through the first light receiving portion 210 during movement of the carriage 205, the LED 101 of each ink tank 1 is turned on, and light from the LED 101 is received by the first light receiving portion 210. Moreover, it is possible to check the position of each ink tank 1 in the carriage 205 on the basis of the position of the carriage 205 obtained when the light from the LED 101 is received.

As another example of a method for controlling lighting of the LED 101, when the ink tank 1 is properly mounted, control is exerted so that the LED 101 of the ink tank 1 is turned on when the ink tank 1 is properly mounted at the tank replacement position. These control operations are carried out according to control data (control signal) transmitted from the control circuit in the main unit to each ink tank 1 via the flexible cable 206, in a manner similar to that for the control of ink discharging by the recording heads.

3. Whole Construction of Control System

Figure 13:
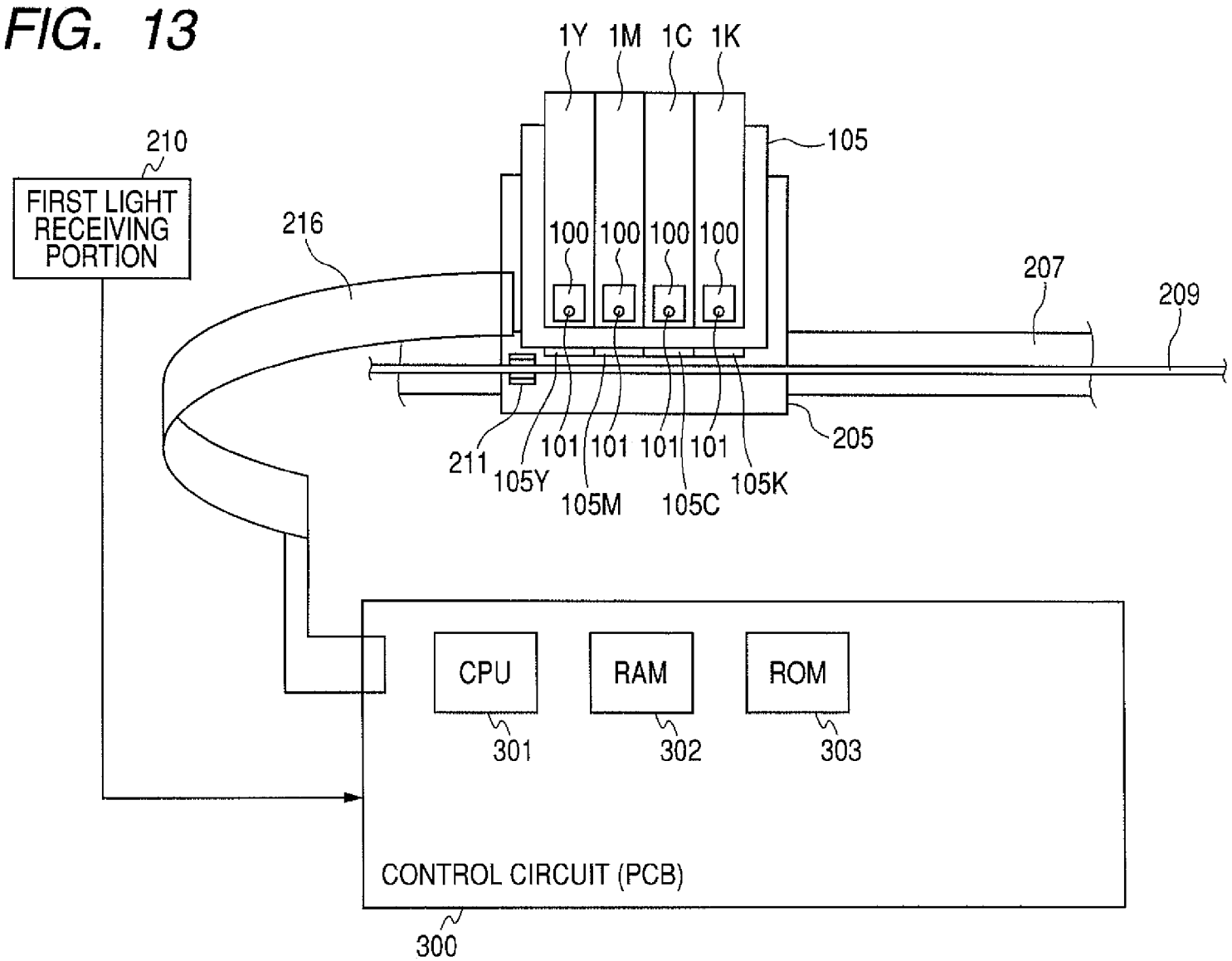
FIG. 13 is a block diagram showing a control construction of the ink jet printer.

FIG. 13 is a block diagram showing an example of the control system of the foregoing ink jet printer 200. The diagram depicts a control circuit in the form of a printed circuit board (PCB) in the ink jet printer 200 main body. In addition, the diagram also depicts the light emission or the like of the LED of the ink tank 1 which is controlled by the control circuit.

In FIG. 13, a control circuit 300 executes a data process and operation control regarding the ink jet printer 200. More specifically, a CPU 301 executes processes or the like in accordance with a program stored in a ROM 303. A RAM 302 is used as a work area upon execution of the processes by the CPU 301.

As shown in FIG. 13, the recording head unit 105 mounted on the carriage 205 includes recording heads 105K, 105Y, 105M, and 105C, where each of the recording heads include a plurality of discharge ports for discharging each ink of black (K), yellow (Y), magenta (M), and cyan (C). The ink tanks 1K, 1Y, 1M, and 1C are detachably mounted to the holder of the recording head unit 105 in correspondence to those recording heads.

As described above, the board 100 having the LED 101, its display control circuit, the pad as a contact terminal, and the like is attached to each ink tank 1. When the ink tank 1 is correctly mounted to the recording head unit 105, the pad on the board 100 contacts the connector provided in correspondence to each ink tank 1 in the recording head unit 105. A connector (not shown) provided for the carriage 205 and the control circuit 300 of the main body side are signal-connected through the flexible cable 206 (The reference number for the flexible cable in FIG. 13 is 216). Further, when the recording head unit 105 is mounted onto the carriage 205, the connector of the carriage 205 and the connector of the recording head unit 105 are signal-connected. By the above connections, a signal can be transmitted and received between the control circuit 300 of the main body side and each ink tank 1. Thus, the control circuit 300 can control turning on and flickering of the LED 101 in accordance with a sequence, which is described below.

Also with respect to the control of the ink discharge from each of the recording heads 105K, 105Y, 105M, and 105C, a driving circuit and the like provided for each recording head are signal-connected to the control circuit 300 of the main body side through the flexible cable 206, the connector of the carriage 205, and the connector of the recording head unit, so that the control circuit 300 can control the ink discharge from each of the recording heads.

The first light receiving portion 210 provided near one end portion in the moving range of the carriage 205 receives the light emitted from the LED 101 of the ink tank 1 and outputs a signal corresponding to the light emission to the control circuit 300. As described in more detail below, the control circuit 300 determines the position of each ink tank 1 on the carriage 205 on the basis of the signal. An encoder scale 209 is provided along the moving path of the carriage 205. An encoder sensor 211 is provided for the carriage 205. A detection signal of this sensor is inputted to the control circuit 300 through the flexible cable 206, so that the moving position of the carriage 205 can be recognized. The position information is used for the discharge control of each recording head and is also used for a position detection process for detecting the position of the ink tank 1, which is described below.

4. Construction of Connecting Portion

Figure 14:
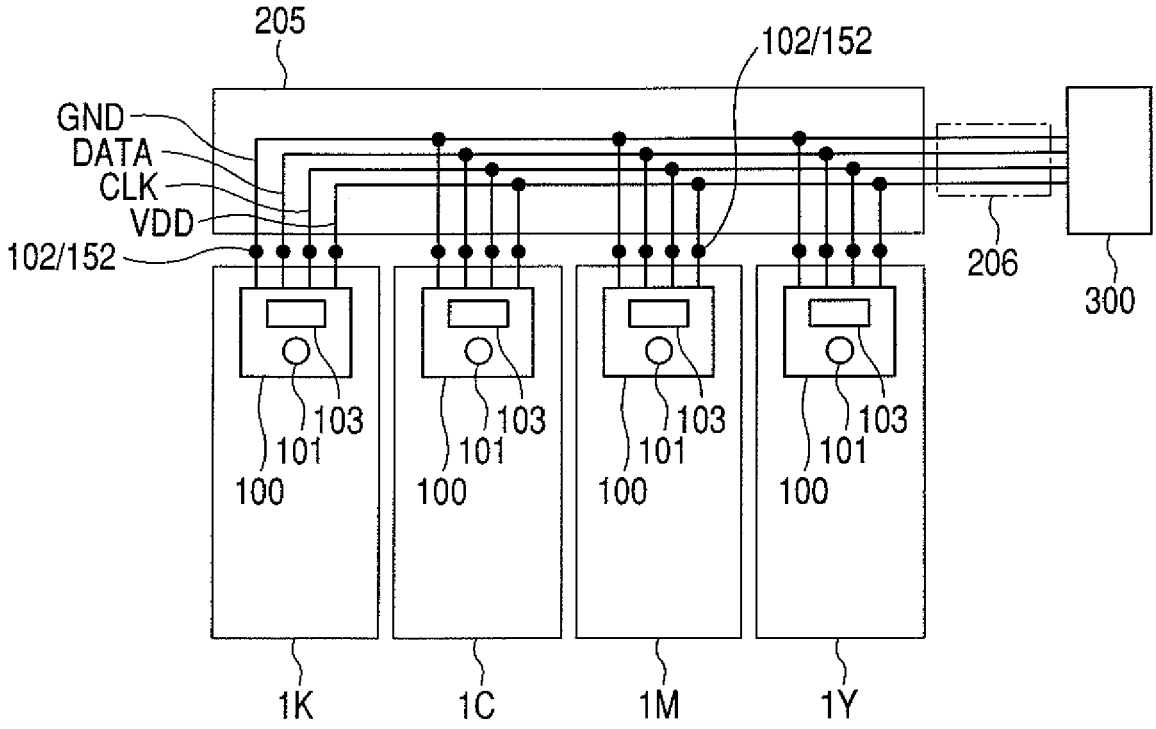
FIG. 14 is a diagram showing a relation between a construction of signal wirings for signal connection to the ink tanks in a flexible cable of the ink jet printer and a board of each ink tank.

FIG. 14 is a diagram depicting a relation between a construction of signal wirings for the signal connection to the ink tanks 1 in the flexible cable 206 and the board 100 of each ink tank.

As shown in FIG. 14, the wiring structure for the four ink tanks 1 is comprised of four signal lines, and is common to the four ink tanks 1 (so called bus connection). That is, a wiring for each respective ink tank 1 comprises four signal lines of, i.e., a power source signal line "VDD", a ground signal line "GND", a signal line "DATA", and its clock signal line "CLK". The power signal line VDD is concerned with the supply of power for the operation of function elements 103 that lights and drives the LED 101 in the ink tank. The signal line "DATA" transmits control signals (control data) relating operations such as turning on and flickering of the LED 101, from the control circuit 300 as will be described below. While the four signal lines are used in the present exemplary embodiment, the present invention is not limited thereto. For example, the ground signal line "GND" may be omitted by obtaining a ground signal by other methods. It is also possible to combine the signal lines "CLK" and "DATA". In this case, it is not necessary to provide a signal line "DATA" for each ink tank 1, and it is possible to reduce the signal wiring in the flexible cable 206.

The control unit 103, which is made operative by the signals on the above described four signal lines, and the LED 101, which is made operative by the control unit 103, are provided on the board 100 of each ink tank 1.

Figure 15:
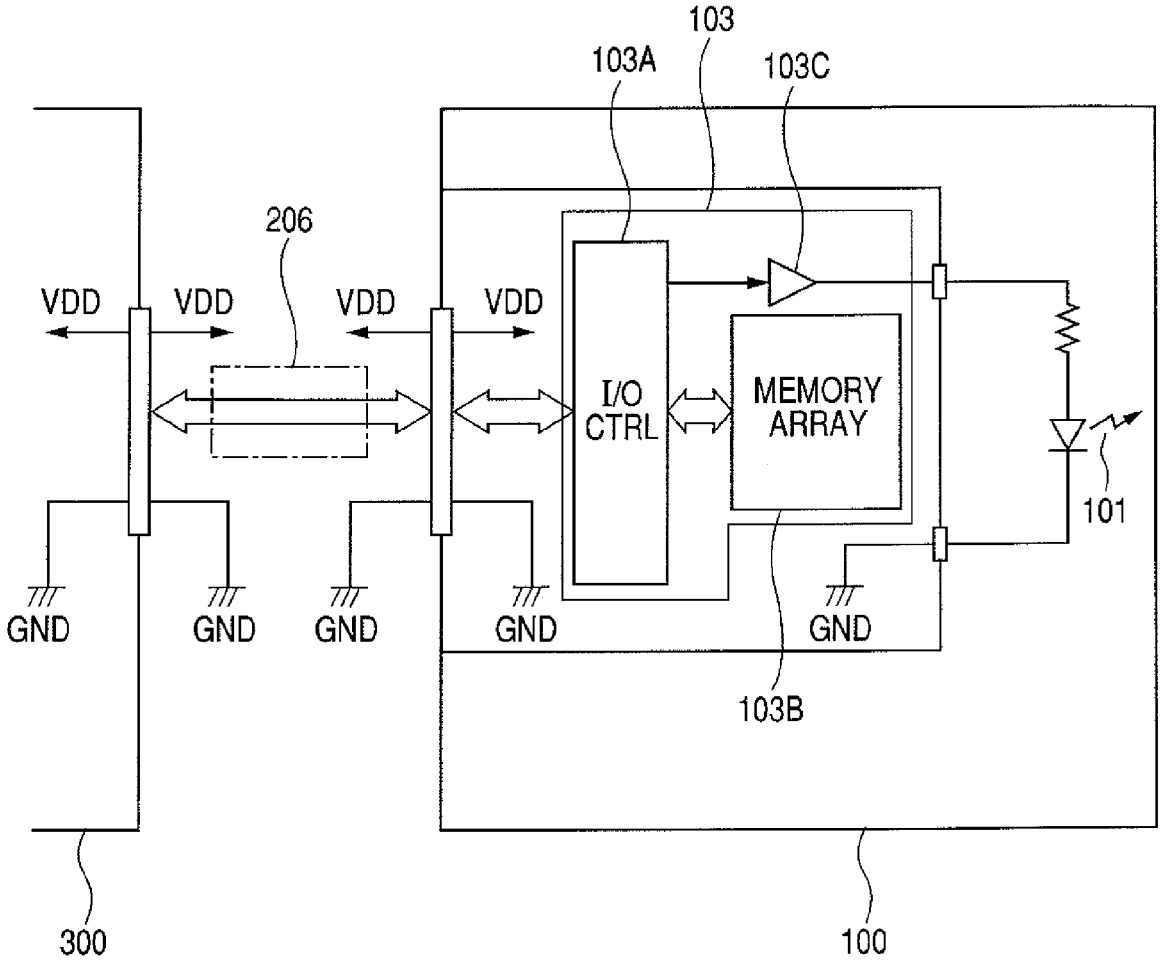
FIG. 15 is a circuit diagram showing details of the board on which a control unit and the like are provided.

FIG. 15 is a circuit diagram showing details of the board 100 on which the control unit 103 and the like are provided. As shown in the diagram, the control unit 103 has an input/output control circuit (I/O CTRL) 103A, a memory array 103B, and an LED driver 103C. The I/O CTRL 103A controls the display driving of the LED 101 and the writing and reading of data into/from the memory array 103B in accordance with control data which is sent from the control circuit 300 of the main body side through the flexible cable 206.

The LED driver 103C operates so as to apply a power source voltage to the LED 101 when a signal, which is outputted from the I/O CTRL 103A is ON, thereby allowing the LED 101 to emit the light. Therefore, when the signal which is outputted from the I/O CTRL 103A is ON, the LED 101 is turned on. When the signal is OFF, the LED 101 is turned off.

Figure 16:
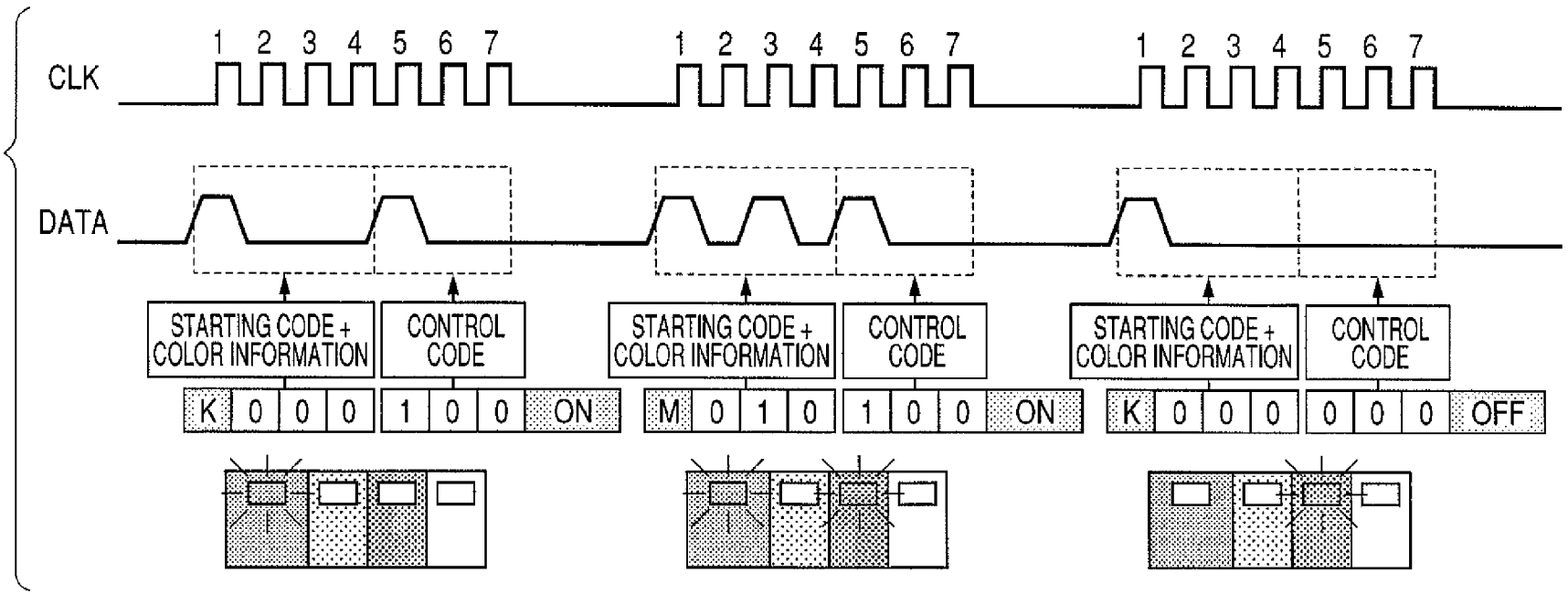
FIG. 16 is a timing chart for explaining the turn-on and turn-off operations of LEDs.

FIG. 16 is a timing chart for explaining the turning on and turning off operations of the LEDs 101.

When the LED 101 is turned on or off, as shown in FIG. 16, in a manner similar to that mentioned above, first, a data signal of "starting code+color information" is sent to the I/O CTRL 103A from the main body side through the signal line "DATA". As mentioned above, the ink tank is specified by the "color information" and turning on and turning off of the LED 101 is based on a "control code" which is sent after that and are performed only for the specified ink tank. A code of "ON" or "OFF" may be used as a "control code" regarding turning on or turning off. The LED 101 is turned on by the "ON" code and is turned off by the "OFF" code. That is, when the control code is "ON", the I/O CTRL 103A outputs an ON signal to the LED driver 103C and also maintains this output state after that. On the contrary, when the control code is "OFF", the I/O CTRL 103A outputs an OFF signal to the LED driver 103C and also maintains this output state after that. As for the actual timing for turning on or turning off the LED 101, the turning on/off operation is executed at the timing after the seventh clock on the clock signal line "CLK" with respect to each data signal shown in FIG. 14.

5. Control Procedure

Figure 4:
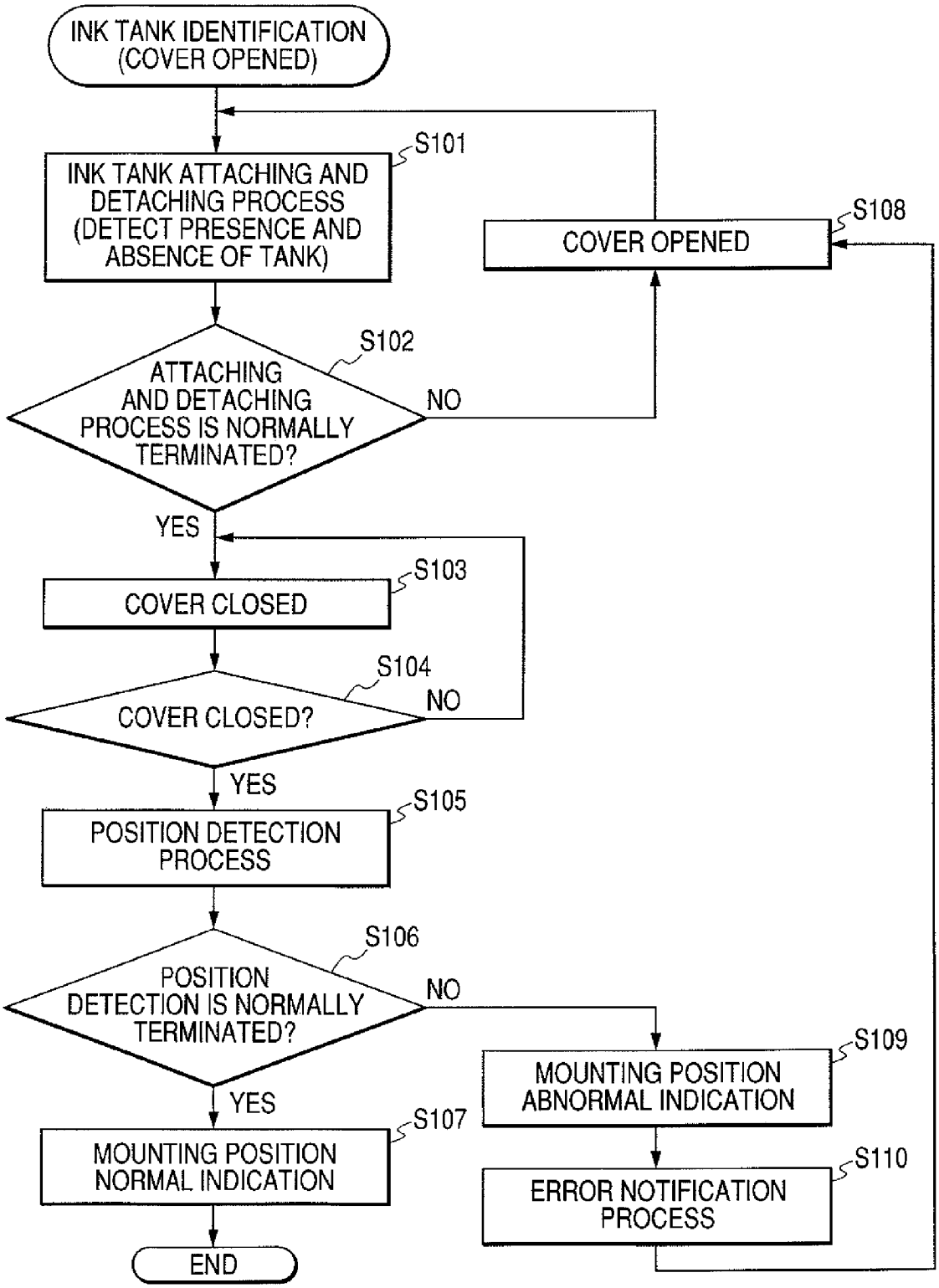
FIG. 4 is a flowchart showing a control procedure regarding attachment and detachment of an ink tank according to the exemplary embodiment of the invention.

FIG. 4 is a flowchart showing a control procedure regarding attachment and detachment of the ink tank 1 based on the present exemplary embodiment. Particularly, FIG. 4 shows the control of turning on and turning off of the LED 101 of each ink tank 1 by the control circuit 300 of the main body side.

When the user opens the main body cover 201 of the ink jet printer 200, the opening is detected by a predetermined sensor, and the processing routine shown in FIG. 4 is activated. When this processing routine is started, first, an attaching and detaching process of the ink tank 1 is executed in step S101.

Figure 5:
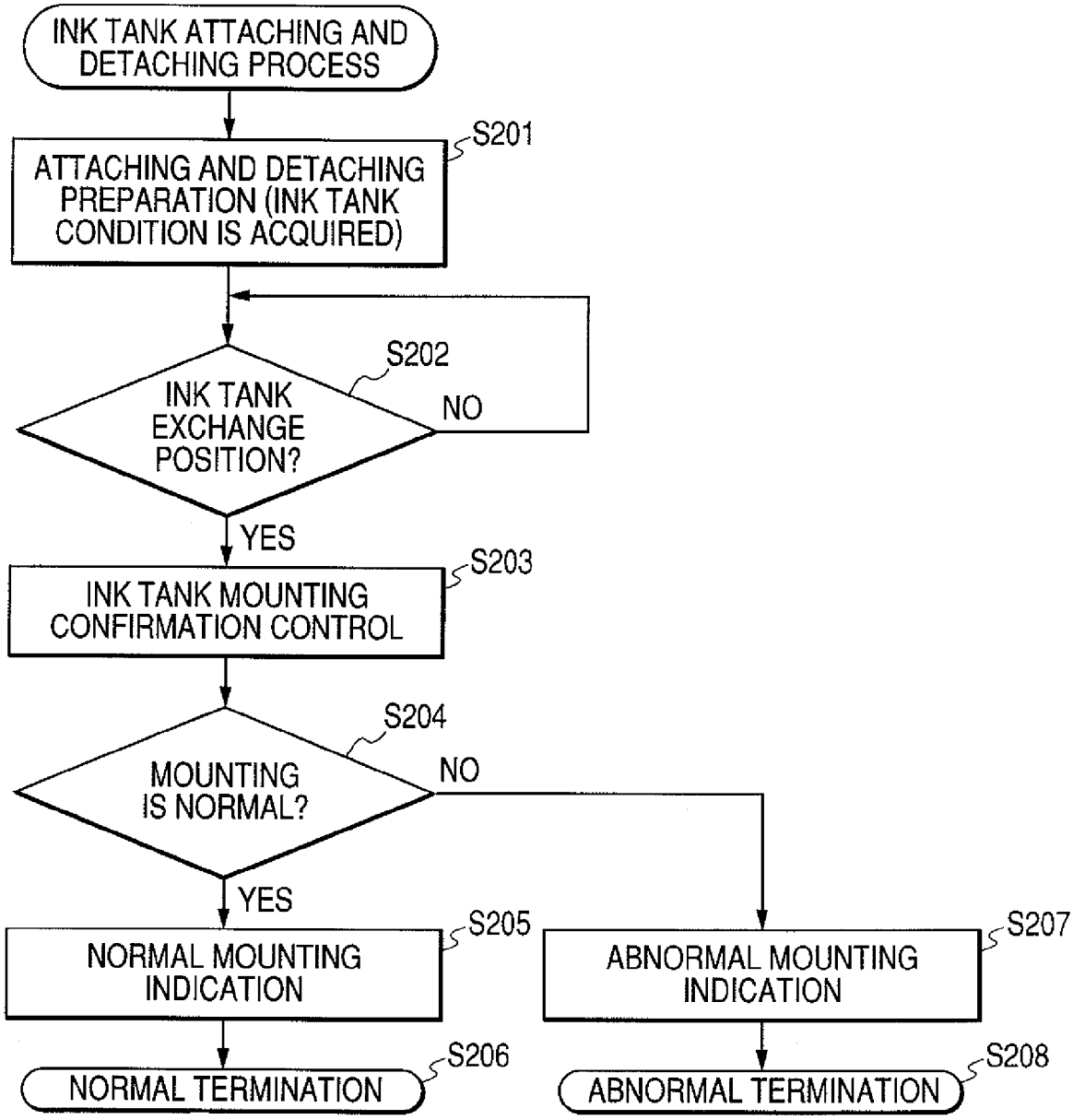
FIG. 5 is a flowchart showing details of an ink tank attaching and detaching process according to the exemplary embodiment of the invention.

FIG. 5 is a flowchart showing details of the ink tank attaching and detaching process. First, in step S201, the carriage 205 is moved and condition information (i.e., individual information of the ink tank 1) is acquired with respect to each of the ink tanks 1 mounted at that time. The condition information includes, but is not limited to, residual amount of the ink and the like which is read out of the memory array 103B together with the unique number of the ink tank 1. Next, in step S202, it is determined whether the carriage 205 has reached the ink tank exchange position described in FIG. 12.

If it is determined that the carriage 205 has reached the ink tank exchange position, ink tank mounting confirmation control is made in step S203.

Figure 6:
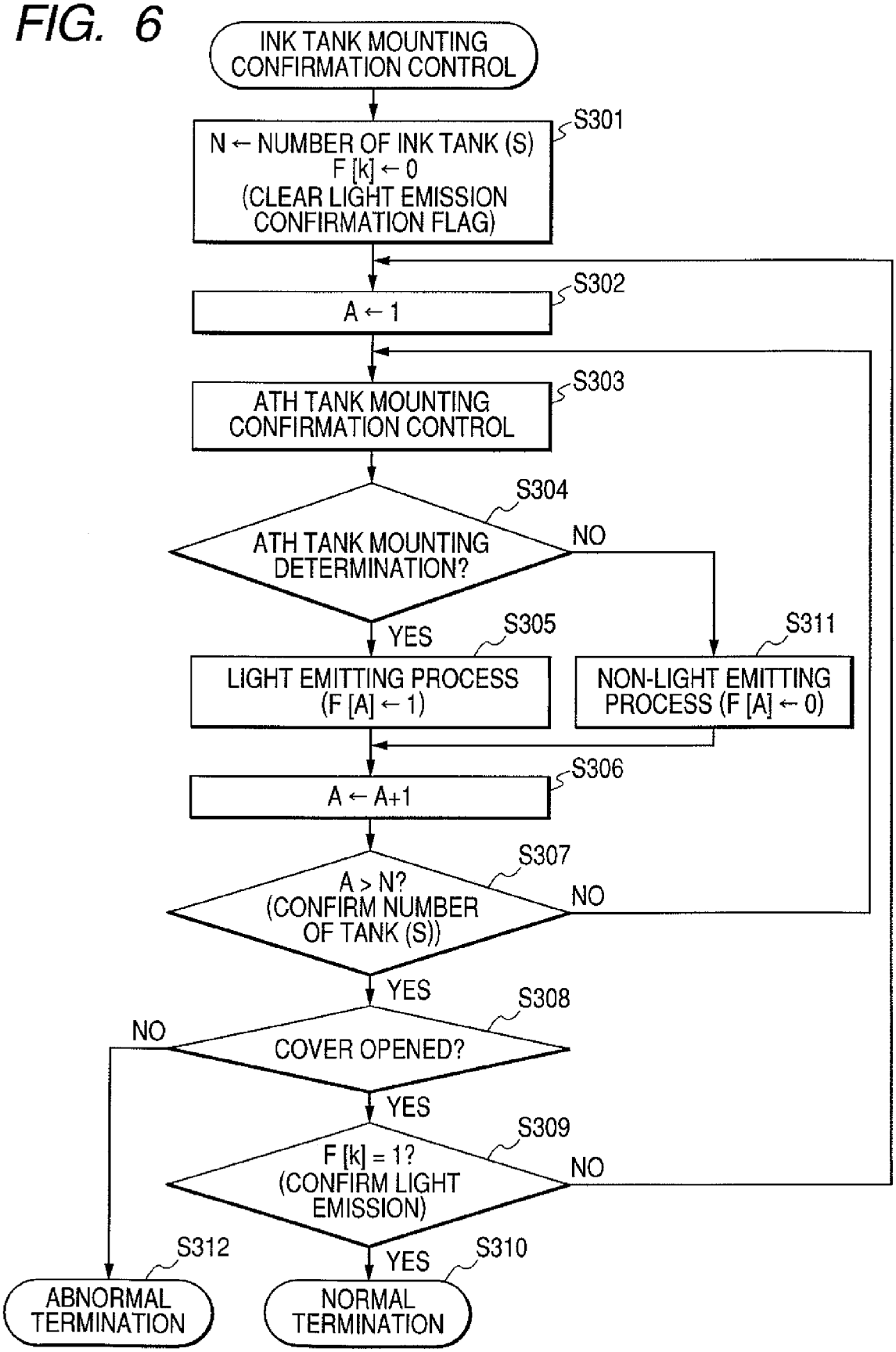
FIG. 6 is a flowchart showing details of ink tank mounting confirmation control according to the exemplary embodiment of the invention.

FIG. 6 is a flowchart showing details of the mounting confirmation control. First, in step S301, a parameter N indicative of the number of ink tanks mounted on the carriage 205 is set and a flag F(k) to confirm the light emission of the LED 101 is initialized in accordance with the number of ink tanks. In the present exemplary embodiment, N is set to 4, which corresponds to the number of ink tanks of K, C, M, and Y. Four flags F(k) (k=1 to 4) are prepared in correspondence to them. All of them are initialized and their contents are set to "0".

Next, in step S302, a variable A regarding the mounting determining order of the ink tanks of the flags is set to "1". Then, in step S303, the mounting confirmation control is made with respect to the Ath ink tank. That is, when a user mounts the ink tank 1 to the correct position of the holder 150 of the recording head unit 105, the contact 152 of the holder 150 mentioned above contacts with the contact 102 of the ink tank 1. Thus, while specifying the ink tank 1 by the color information as individual information of the ink tank 1 as mentioned above, the control circuit 300 of the main body side sequentially reads out the color information stored in the memory array 103B of the specified ink tank 1. As for the color information to specify the ink tank 1, the color information which has already been read is not used. Further, after the present processing routine is activated, it is also determined whether the read-out color information differs from the color information which has already been read out.

When the color information can be read out and this color information differs from the color information which has already been read out, it is determined in step S304 whether the ink tank of such color information has been mounted as an Ath ink tank. The "Ath" order denotes the order of making the determination about the ink tank and does not denote the order showing the mounting positions of the ink tanks. If it is determined that the Ath ink tank has been mounted, then in step S305, the contents of the flag F(A), that is, the contents of the flag F(A) corresponding to k=A among the prepared four flags F(k) (k=1 to 4) are set to "1". As mentioned above in FIG. 5, the LED 101 of the ink tank 1 of the relevant color information is turned on. If it is determined that the Ath ink tank is not mounted, the contents of the flag F(A) are set to "0" in step S311.

Next, in step S306, the variable A is increased by "1". In step S307, it is determined whether the variable A is larger than the value of N set in step S301 (N=4 in the case of the printer in the embodiment). If it is determined that the variable A is equal to or less than N, the processes in step S303 and subsequent steps are repeated. If it is determined that the variable A is larger than N, the mounting confirmation control is terminated with respect to all of the four ink tanks 1.

In step S308, it is determined whether the main body cover 201 has been opened based on the output of the sensor. That is, when the main body cover 201 is closed, there is a possibility that, for example, the user closed the cover in the state where some of the ink tanks 1 have not yet been mounted or they some have not been completely mounted. If it is determined that the main body cover 201 has not been opened, flow proceeds to step S312, where a status showing an abnormal condition is returned to the processing routine of FIG. 5 and the present processing routine is terminated.

If it is determined in step S308 that the main body cover 201 has been opened, then in step S309, it is determined, with respect to all of the four flags F(k) (k=1 to 4), whether the contents are equal to "1". That is, with respect to all of the ink tanks 1, it is determined whether the LED 101 has been turned on. If it is determined that the LED 101 of any one of the ink tanks 1 is not turned on, the processes in step S302 and subsequent steps are repeated. That is, the above processes are repeated until the user has mounted the ink tank 1 whose LED 101 is not turned on or has retried the mounting operation and the LED 101 of such an ink tank 1 is turned on.

Figure 17A:
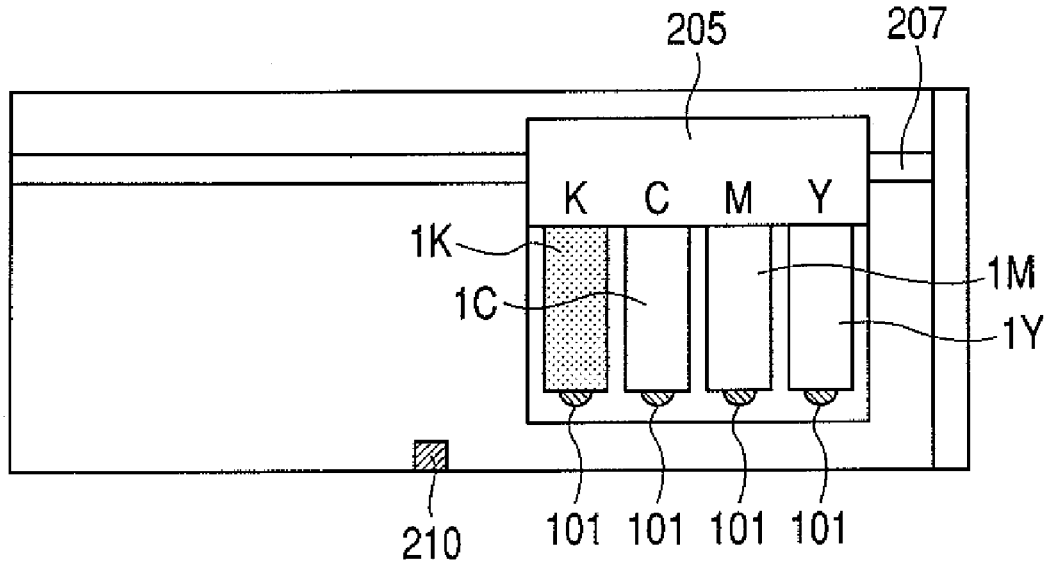
FIG. 17A is a diagram showing the state where all of the ink tanks have correctly been mounted and their LEDs have been turned on in the control regarding the attachment and detachment of the ink tank.

If it is determined that the LEDs 101 of all of the ink tanks 1 have been turned on, the normal terminating operation is executed in step S310, the processes are terminated, and the processing routine is returned to the processing routine shown in FIG. 5. FIG. 17A is a diagram showing the state where all of the ink tanks have correctly been mounted and their respective LEDs 101 have been turned on.

Returning to FIG. 5, following the ink tank mounting confirmation control in step S203, in step S204, it is determined whether such control has been normally terminated. That is, a determination is made whether the ink tank has been mounted normally. If it is determined that the mounting is normal, then in step S205, the display in the operating portion 213 (FIG. 12) is lit, (i.e., green light appears). The processing routine is then normally terminated in step S206 and returned to the processing routine shown in FIG. 4. If it is determined that the mounting is not normal, then in step S207, the display in the operating portion 213 is flickered (i.e., light flickers orange). The processing routine is abnormally terminated in step S208 and returned to the processing routine shown in FIG. 4. If a host PC for controlling the recording apparatus has been connected, the abnormal mounting indication can be simultaneously performed through the PC monitor.

Returning to FIG. 4, when the ink tank attaching and detaching process in step S101 is terminated, it is determined in step S101 whether the attaching and detaching process has been normally terminated. If it is determined that the process has abnormally been terminated, flow proceeds to step S108, where the apparatus waits until the user opens the main body cover 201. When the main body cover 201 is opened, the process of step S101 is started and the processes described in FIG. 5 are repeated.

Figure 17B:
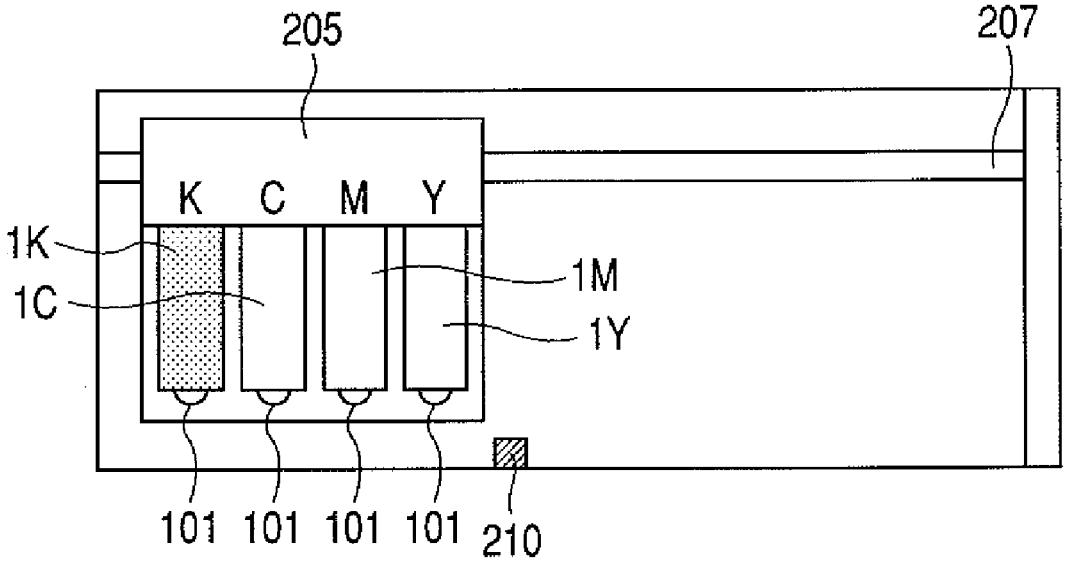
FIG. 17B is a diagram for explaining the state where since a main body cover has been closed after the turn-on of the LED, and the carriage is moved to a position where the position detection is performed.

If it is determined in step S102 that the attaching and detaching process has normally terminated, flow proceeds to step S103, where the apparatus waits until the user closes the main body cover 201. Next, in step S104, is determined whether the cover 201 has been closed. If it is determined that the main body cover 201 has been closed, the processing routine advances to a position detection process in step S105. At this time, as shown in FIG. 17B, if it is detected that the main body cover 201 has been closed, the carriage 205 is moved to the position where the position detection is performed and the LED 101 of each ink tank in the ON state is turned off.

The position detection process is a process to determine whether each of the ink tanks 1 which were normally mounted have been mounted at the correct position (hereinafter, the mounting position of the yellow ink tank 1Y is presumed to be the Y position, the mounting position of the magenta ink tank 1M is presumed to be the M position, the mounting position of the cyan ink tank 1C is presumed to be the C position, and the mounting position of the black ink tank 1K is presumed to be the K position). A possibility exists that the ink tank 1 of each color is incorrectly mounted in a position other than its intended position (e.g., the cyan ink tank 1C is mounted in the yellow position Y and the yellow ink tank 1Y is mounted in the cyan position C). In order to avoid such a situation, the position detection process is executed, and if an ink tank 1 has been incorrectly mounted, the user is notified of such a fact. The position detection process, as compared to other methods for ensuring ink tanks are correctly mounted such as making the shape of each ink tank slightly different, increases the efficiency and lowers the cost of manufacturing the ink tanks since the shapes of the ink tanks do not have to be different for every color.

FIGS. 1A to 3C are diagrams for explaining the position detection process of the present exemplary embodiment.

Figure 7:
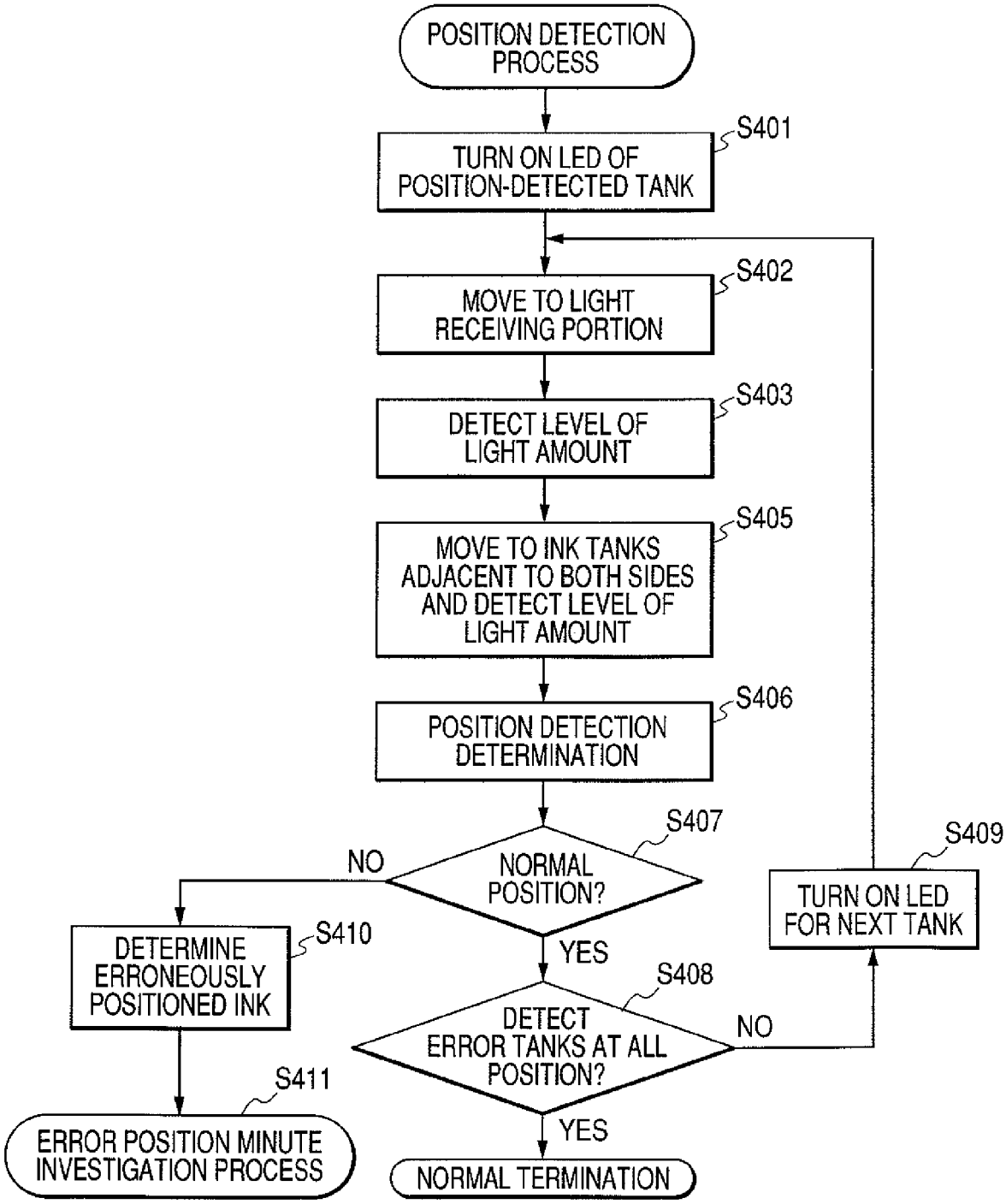
FIG. 7 is a flowchart showing details of the position detection process according to the exemplary embodiment of the invention.
Figure 8:
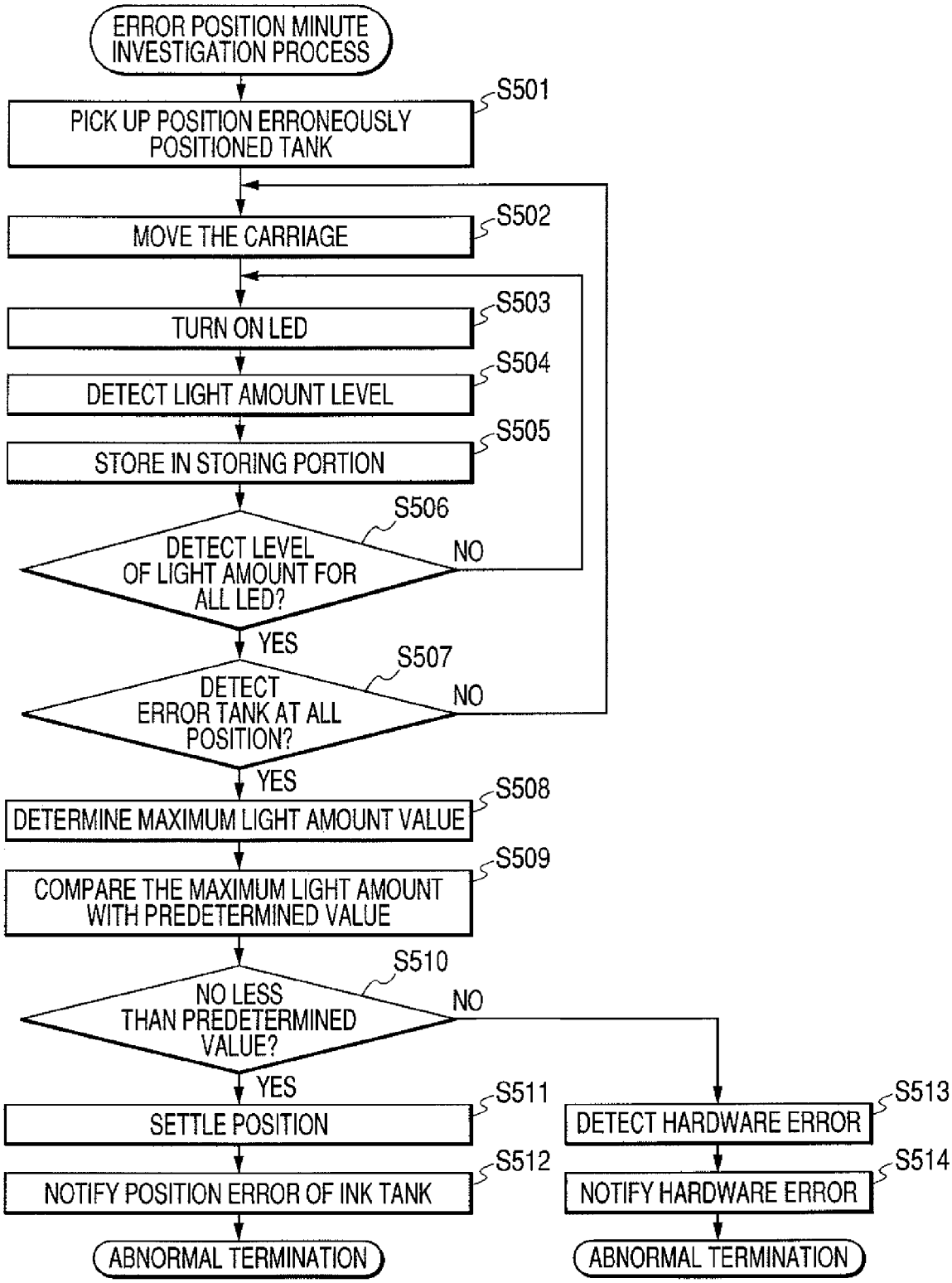
FIG. 8 is a flowchart showing details of the error position minute investigation process according to the exemplary embodiment of the invention.

FIGS. 7 and 8 are flowcharts each showing a position detection processing procedure of the present exemplary embodiment.

In the position detection process, the LED 101 of the ink tank whose position should be detected is turned on. The determination of whether the ink tank 1 whose position should be detected has been mounted at the correct position is based on the light amounts which can be detected by the light receiving portion 210 in front of such a target ink tank and in front of each of the positions of the ink tanks adjacent to both sides of the target ink tank. The determination based on the light amounts is made under the following conditions.

1. The light amount which is obtained at the position of the ink tank whose position should be detected is compared with the light amounts at the positions ink tanks to the right and left of that ink tank. The light amount at the position of the ink tank whose position should be detected is larger than those of the ink tanks to the right and left and a difference between them is equal to or larger than a predetermined value (A).

2. A ratio between the light amount which is obtained at the position of the ink tank whose position should be detected and that obtained when the position is moved to the position of each of the ink tanks to the right and left ink is equal to or larger than a predetermined value (B).

3. The light amount which is obtained at the position of the ink tank whose position should be detected is equal to or larger than a predetermined value (C).

Even if a variation of the light emission amounts of the LEDs 101 of the ink tanks is large, the result obtained by comparing the light amount at a predetermined position with that at the position away from that position is compared with the predetermined values A and B, and the light emission amount of the LED of each ink tank is compared with the predetermined value C, so that it can be determined whether the ink tank has been mounted at the predetermined position. It is presumed that when each ink tank is mounted at the correct position, those predetermined values have been predetermined in consideration of various kinds of variations such as light amount variation of the LEDs, light amount detection variation of the light receiving portions, and the like. In other words, if the ink tank is mounted at the correct position, those values are expected to be satisfied.

As for the ink tanks adjacent to both sides of the carriage, no ink tank exists on one side of the both sides of the ink tank. More specifically, no ink tank exists the left edge of the carriage and no ink tank exists at the right edge of the carriage. Therefore, the light amount at such a position is not detected.

Figure 2A:
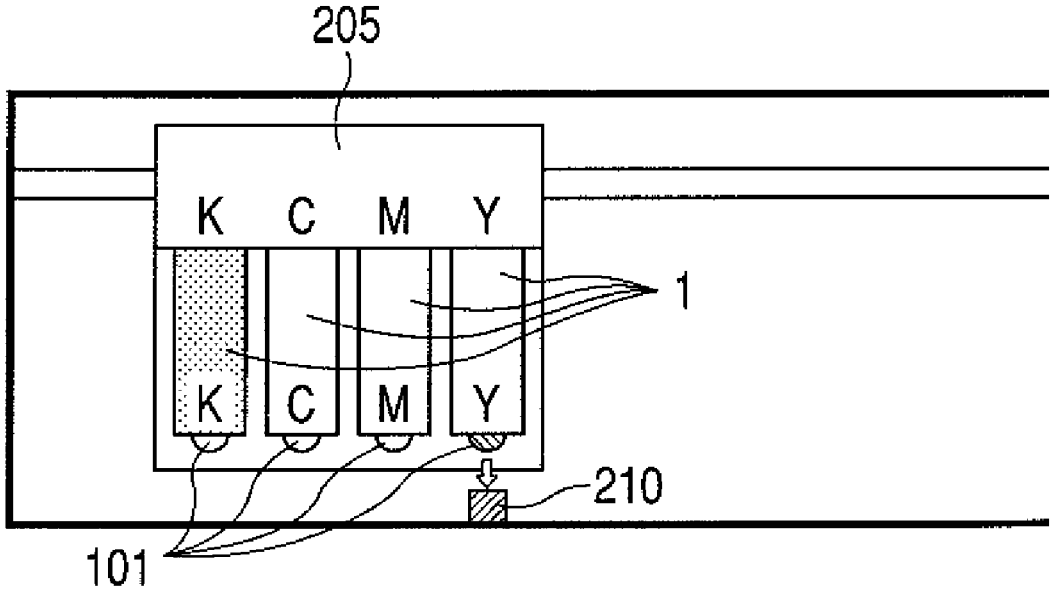
FIGS. 2A and 2B are diagrams for explaining a position detection process in the exemplary embodiment of the invention.
Figure 2B:
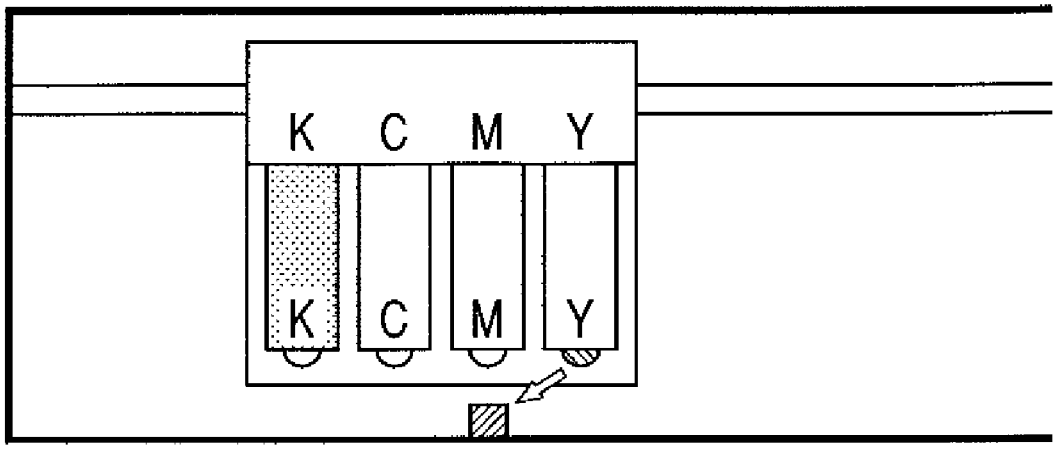
Figure 3A:
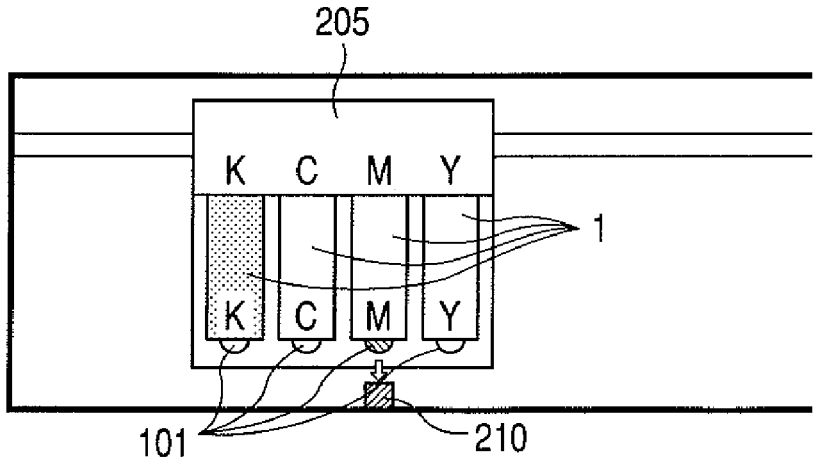
FIGS. 3A, 3B and 3C are diagrams for explaining the position detection process in the exemplary embodiment of the invention.
Figure 3B:
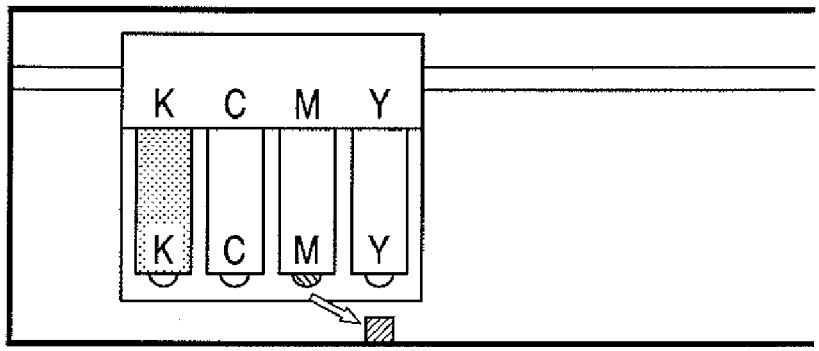
Figure 3C:
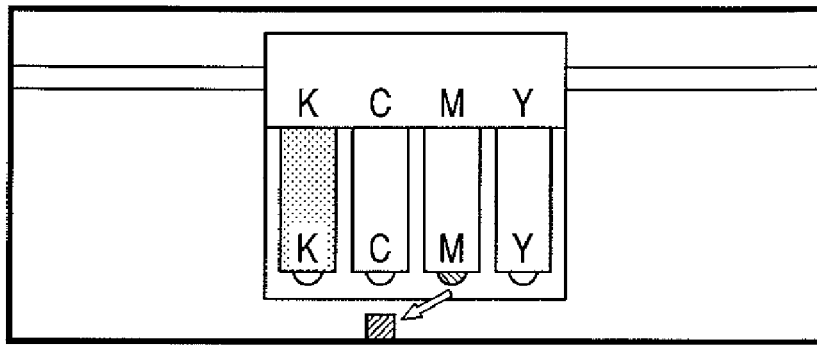

The specific operation will be described with reference to FIGS. 2A to 3C and 7. FIGS. 2A and 2B are diagrams showing the operation to detect the position of the yellow ink tank 1Y. FIGS. 3A to 3C are diagrams showing the operation to detect the position of the magenta ink tank 1M.

When the position of the yellow ink tank 1Y is detected, the LED 101 of the yellow ink tank 1Y is turned on (step S401 of FIG. 7) as shown in FIG. 2A. The carriage is moved so that the light receiving portion 210 faces the Y position (step S402 of FIG. 7). The light amount at this time is detected by the light receiving portion 210 (step S403 of FIG. 7). Subsequently, as shown in FIG. 2B, the carriage is moved so that the light receiving portion 210 faces the M position, and the light amount of the LED 101 of the yellow ink tank 1Y is detected (step S405 of FIG. 7). The levels of the light amounts detected at those positions are compared under the foregoing conditions, thereby performing the position detection determination (step S406 of FIG. 7). If the yellow ink tank 1Y has been mounted at the correct position, since the LED 101 of the yellow ink tank 1Y emits the light at the Y position, the light amount level at the Y position is higher than that at the M position and satisfies the predetermined values A, B, and C.

If the yellow ink tank 1Y is incorrectly mounted at the M position, the light amount detection level at the M position is higher than the predetermined value A, so that condition 1 is not satisfied.

If the yellow ink tank 1Y is mounted at a position that is far from the light receiving portion 210, for example, at the K position, the light amount level at each of the Y and M positions is smaller than the predetermined values B and C, so that conditions 2 and 3 are not satisfied.

When it is determined that the ink tank 1 is not mounted at the correct (normal) position (S407 of FIG. 7), it is determined that the yellow ink tank 1Y is not correctly mounted at the Y position (step S410). An error position minute investigation process, which is described below, is executed (step S411 of FIG. 7).

A determination is made whether the position detection process needs to be executed with respect to the rest of the ink tanks 1 (step S408 of FIG. 7). If the position detection process still needs to be executed, then the LED 101 for the next ink tank 1 is turned on (step S409 of FIG. 7). For example, the LED of the magenta ink tank 1M is turned on and a determination is made whether the magenta ink tank 1M is correctly mounted. The process would then be repeated for the yellow ink tank 1Y and the cyan ink tank 1C as necessary. The light amounts of the light receiving portion 210 at the M position, Y position, and C position are detected as shown in FIGS. 3A to 3C, and the levels of the light amounts at those positions are determined under the foregoing conditions.

The error position minute investigation process, as shown in FIG. 8, will now be explained.

First, in step S501, the ink tank which has been determined by the foregoing position detection process to be mounted at an incorrect position (hereinafter, referred to as an incorrectly positioned tank) is picked up. In step S502, the carriage 205 is moved so that the light receiving portion 210 faces the first incorrectly positioned tank. Next, in step S503, the LEDs 101 of all of the ink tanks 1 picked up as incorrectly positioned tanks are sequentially turned on, and in step S504, the light amounts at that time are detected by the light receiving portion 210.

In step S505, the values of the levels of the detected light amounts are temporarily stored into the RAM 302 of the control circuit 300. Next, in step S506, the carriage is similarly moved so that the light receiving portion 210 faces all of the erroneously positioned tanks and the light amount levels when the LEDs of the erroneously positioned tanks have been made to emit the light are detected and stored into the RAM 302.

After the light amount levels are detected and temporarily stored in the RAM 302, a determination is made in step S507 whether all ink tank positions have been examined. If all of the ink tank positions have not been examined, the flow returns to step S502. If all of the ink tank positions have been examined, the flow proceeds to step S508.

In step S508, the maximum light amount value is determined from the levels of the received light amount by the processes of the CPU 301 in the control circuit 300 in correspondence to the ink tank which the light receiving portion 210 faces. In step S509, the maximum light amount value is compared with the predetermined values A, B, and C which have previously been stored in the ROM 303 in the control circuit 300 by the processes of the CPU 301. Next, in step S510, it is determined whether, as a result of the comparison with each predetermined value, the maximum value is greater than the predetermined. When the maximum value is greater than the predetermined value, the flow proceeds to step S511, where it can be determined that the ink tank having the LED which indicated the maximum value has incorrectly been mounted at the position where the light receiving portion 210 faces such an ink tank. Then, step S512, notification of the incorrect mounting position is provided.

If the comparison between the maximum value and each of the predetermined values in step S510 results in the maximum value being smaller than the predetermined value, the flow proceeds to step S513. In step S513, a check is made whether any hardware errors exist. This is done since even if the LED of the ink tank which faces the light receiving portion 210 is turned on, the predetermined light amount cannot be detected due to a hardware problem. For example, it is possible to determine that a problem, such as a failure or the like, has occurred in the light receiving portion 210 or the necessary light receiving characteristics were not presented due to an influence of ink mist. If a hardware error is detected, then in step S514, notification of the error is provided. For example, if the ink jet printer 200 is connected to a PC, the notification will be generated on the PC's monitor.

An example applying the above described control process will now be provided with reference to FIGS. 1A to 2B.

Figure 1B:
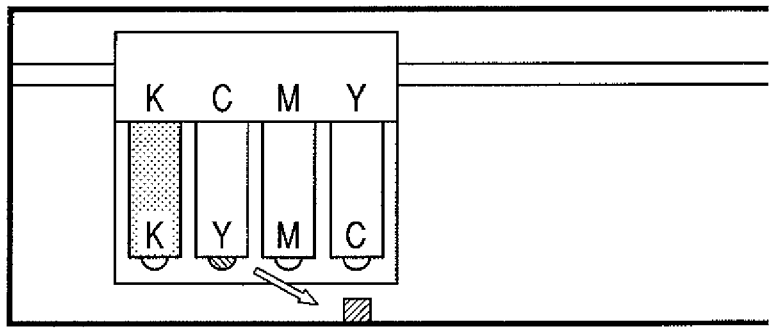
Figure 1C:
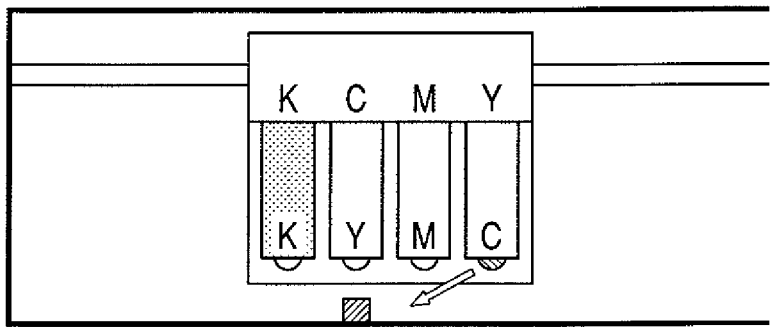
Figure 1D:
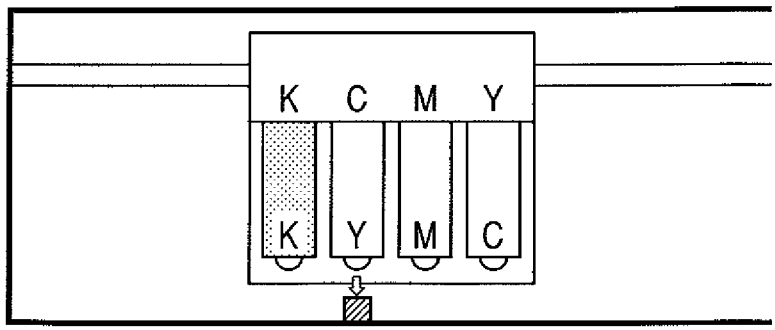

First, as shown in FIG. 1A, if it is determined that the yellow ink tank 1Y and the cyan ink tank 1C are the incorrectly positioned tanks, the carriage 205 is moved such that light receiving portion 210 faces the Y position, the LED 101 of the cyan ink tank 1C is turned on, the detected light amount level is set to L(YC). This value is then stored in RAM 302). Next, as shown in FIG. 1B, the LED 101 of the yellow ink tank 1Y is turned on, the detected light amount level is set to L(YY), and this value is stored in the RAM 302. Then, as shown in FIG. 1C, the carriage 205 is moved such that the light receiving portion 210 faces the cyan C position, the LED 101 of the cyan ink tank 1C is turned on, the detected light amount level is set to L(CC), and this value is stored in the RAM 302. Finally, as shown in FIG. 1D, the LED 101 of the yellow ink tank 1Y is turned on, the detected light amount level is set to L(CY), and this value is stored in the RAM 302.

When the two ink tanks 1 are determined to be the incorrectly positioned tanks, since those ink tanks 1 have been replaced, the maximum value is obtained from the stored light amount levels L(YC) and L(YY), so that L(YC) becomes the maximum value. Similarly, the maximum value is obtained from the stored light amount levels L(CC) and L(CY), so that L(CY) becomes the maximum value.

The maximum values L(YC) and L(CY) are compared with each of the predetermined values. Since each of those maximum values indicates the light amount of the LED 101 of the ink tank 1 which faces the light receiving portion 210, when the light receiving portion 210 is normal, the level which is equal to or larger than each predetermined value can be detected. Therefore, it is possible to decide that the cyan ink tank 1C has been incorrectly mounted at the Y position and the yellow ink tank 1Y has been incorrectly mounted at the C position.

In the case where three or more ink tanks 1 are determined to be the incorrectly positioned tanks, the above-described process is also executed. Specifically, when the detected light amount level of the LED 101 of the ink tank 1 of the color in which the detection level of the light receiving portion 210 is the largest is equal to or higher than the predetermined level, it can be determined that the ink tank 1 of such a color has been mounted at the position where it faces the light receiving portion 210.

When the light amount level of the maximum value L(YC) or L(CY) is smaller than at least one of the three predetermined values A, B, and C, it can be determined that some abnormality has occurred in the light receiving portion 210 or the detecting characteristics were deteriorated due to a hardware error, such as depositing of ink mist.

Turning back to FIG. 4, following the position detection process of step S105, as described above, a determination is made in step S106 whether this process has terminated normally. If it is determined that the position detection process has terminated normally, the flow proceeds to step S107, where the display in the operating portion 213 is turned on (e.g., green light appears) and the processing routine is terminated.

If, however, it is determined that the position detection process has not terminated normally, the flow proceeds to step S109, where the display in the operating portion 213 is flickered (e.g., flickering orange light appears). Then, in step S110, the LED 101 of the ink tank 1 which is not mounted at the correct position and which has been specified in step S105 is, for example, flickered or turned on. Thus, when a user opens the main body cover 201 in step S108, the user can determine which, if any, ink tank 1 is not correctly mounted.

If it is determined by the error position minute investigation process that the failure of the light receiving portion 210 or the deterioration of the detecting characteristics due hardware errors (i.e., depositing of ink mist), since the ink jet printer 200 is in an error state from which recovery via user operation is difficult. The user can be notified of the existence of the error state via the display portion of the ink jet printer 200.

Although the position detection process has been executed in the above described exemplary embodiment by comparing the detected light amount with the three conditions, that is, the three predetermined values, it is also possible to satisfy two conditions by comparing the detected light amount with the two predetermined values.

Figure 9:
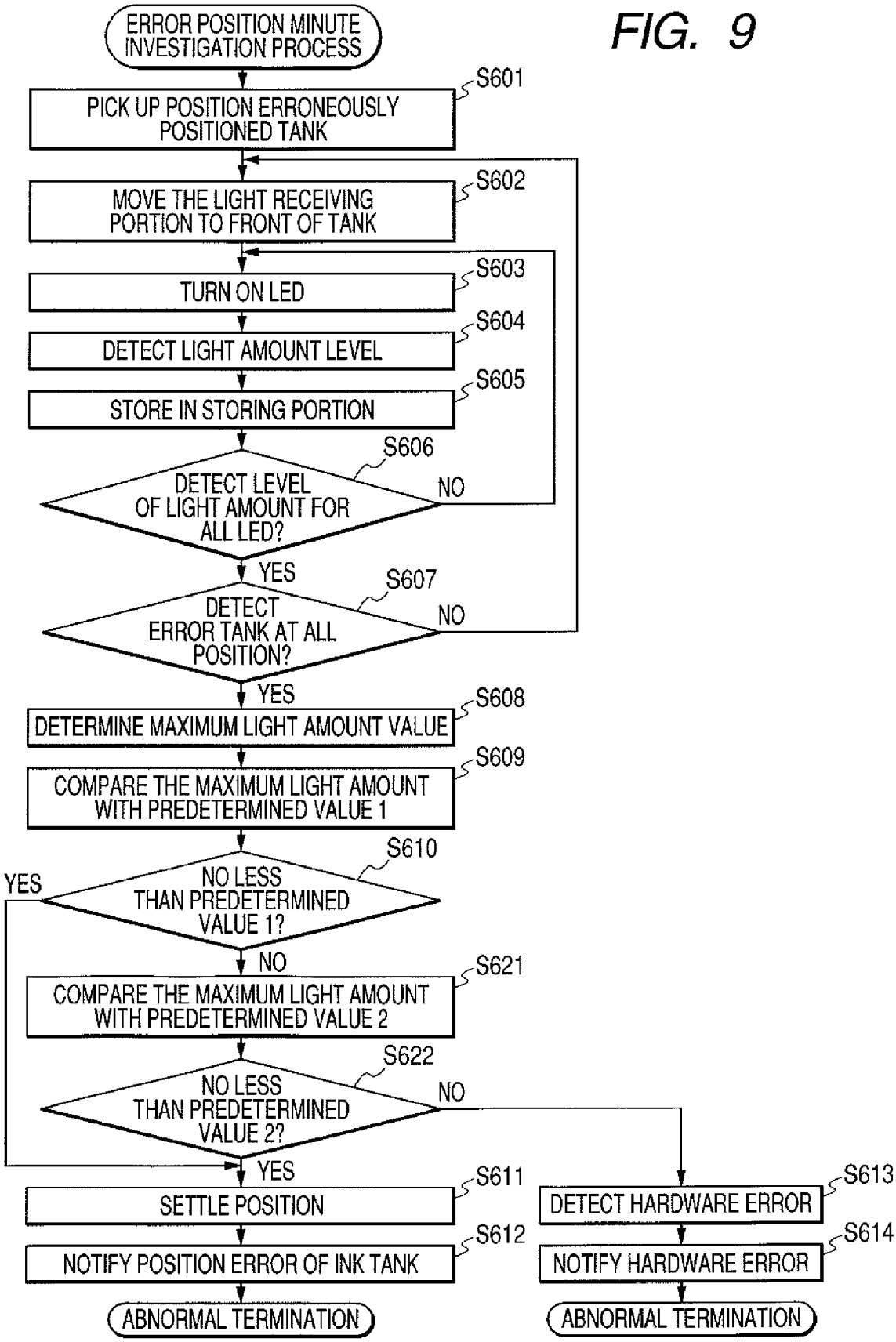
FIG. 9 is a flowchart showing details of an error position minute investigation process according to another exemplary embodiment of the invention.

FIG. 9 is a flowchart showing another exemplary embodiment of the error position minute investigation process according to the present invention.

The process up to the determination of the maximum light amount value in step S608 is the same as that in the foregoing embodiment. As such, a detailed description thereof is omitted herein. In the current embodiment, two predetermined values to be compared with the maximum light amount values have previously been stored in the ROM 303 in the control circuit 300.

First, in step S609, the maximum light amount value is compared with the first predetermined value. Next, in step S610, a determination is made whether maximum light amount value is larger than the first predetermined value. If it is determined that the maximum light amount value is larger, the flow proceeds to step S611. Steps S611 and S612 are identical to steps S511 and S512 of FIG. 8 described above. As such, a detailed description of these steps is omitted herein.

If it is determined that the maximum light amount value is smaller than the first predetermined value, the flow proceeds to step S621, where the maximum light amount value is compared with the second predetermined value. The flow then proceeds to step S622. Steps S622, S613, and S614 are identical to steps S510, S513, and S514 of FIG. 8 as described above. As such, a detailed description of these steps is omitted herein.

The second predetermined value is set to a value smaller than the first predetermined value. As a result of the comparison, if the maximum value is smaller than the second predetermined value, it can be determined that an ink tank 1 has been arranged at the abnormal position.

According to the above described exemplary embodiments, it can be determined whether the photosensitive device of a recording apparatus main body side has failed. As a result, repair of the main body side can be promptly requested without a user unnecessarily exchanging ink tanks.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-180557 filed on Jun. 21, 2005, which is hereby incorporated by reference herein.

What is claimed is:

1. A recording apparatus including a plurality of ink tanks mounted in a carriage, the plurality of ink tanks having respective light emitting portions, the recording apparatus comprising:

a light receiving portion adapted to receive light from the light emitting portions;

a light emission control unit adapted to control a light emitting portion of a predetermined one of the ink tanks to emit light;

a first determining unit adapted to determine whether a mounting position of the predetermined ink tank is correct based on a result obtained when the light receiving portion has received the light emitted from the light emitting portion at a plurality of positions;

a driving unit adapted to drive the carriage;

a second determining unit adapted to, if the predetermined ink tank is determined by the first determining unit that the mounting position of the predetermined ink tank is incorrect, determine a maximum value from results obtained when the driving unit has driven the carriage to a position where the mounting position of the ink tank whose mounting position is incorrect faces the light receiving portion and, thereafter, the light emission control unit further controls the light emitting portion of the ink tank whose mounting position is incorrect to sequentially emit light at a plurality of positions; and a third determining unit adapted to determine that an abnormality has occurred in the light receiving portion if the maximum value determined by the second determining unit does not satisfy a predetermined value.

2. An apparatus according to claim 1, further comprising a comparing unit adapted to compare the maximum value with the predetermined value, and wherein as a result of the comparison by the comparing unit, if the maximum value is smaller than the predetermined value, the third determining unit determines that the abnormality has occurred in the light receiving portion.

3. An apparatus according to claim 1, further comprising a comparing unit adapted to compare the maximum value with a plurality of predetermined values, and wherein as a result of the comparison by the comparing unit, if the maximum value satisfies all of the predetermined values, the third determining unit determines that the abnormality has occurred in the light receiving portion.

4. An apparatus according to claim 1, further comprising a notifying unit adapted to notify a result determined by the third determining unit.

5. A position detecting method of an ink tank of a recording apparatus, the recording apparatus including a plurality of ink tanks having respective light emitting portions and a carriage on which the plurality of ink tanks are mounted, the method comprising:

receiving light from the light emitting portions by a light receiving portion;

controlling a light emitting portion of a predetermined one of the ink tanks to emit light;

determining whether a mounting position of the predetermined ink tank is correct based on a result obtained when the light receiving portion has received the light emitted from the light emitting portion at a plurality of positions;

driving the carriage;

determining, if the predetermined ink tank is previously determined that the mounting position of the predetermined ink tank is incorrect, a maximum value from results obtained when the carriage has been driven to a position where the mounting position of the ink tank whose mounting position is incorrect faces the light receiving portion and, thereafter, the light emitting portion of the ink tank whose mounting position is incorrect is further controlled to sequentially emit light at a plurality of positions; and determining that an abnormality has occurred in the light receiving portion if the previously determined maximum value decided does not satisfy a predetermined value.

6. A method according to claim 5, further comprising comparing the maximum value with the predetermined value, and wherein as a result of the comparison, if the maximum value is smaller than the predetermined value, the predetermined ink tank is determined that the abnormality has occurred in the light receiving portion.

7. A method according to claim 5, further comprising comparing the maximum value with a plurality of predetermined values, and wherein as a result of the comparison, if the maximum value satisfies all of the predetermined values, the predetermined ink tank is determined that the abnormality has occurred in the light receiving portion.

8. A method according to claim 5, further comprising notifying a result that the abnormality has occurred in the light receiving portion.

* * * * *